US010730593B2

(12) United States Patent
Mishima et al.

(10) Patent No.: US 10,730,593 B2
(45) Date of Patent: Aug. 4, 2020

(54) DEVICE, PROGRAM AND RECORDING MEDIUM FOR ASSISTING MAINTENANCE OF MARINE EQUIPMENT

(71) Applicant: NIPPON YUSEN KABUSHIKI KAISHA, Tokyo (JP)

(72) Inventors: Takashi Mishima, Tokyo (JP); Kanefumi Uematsu, Tokyo (JP); Masahiro Shibaoka, Tokyo (JP); Hiroshi Nakatani, Tokyo (JP); Tomoo Oishi, Tokyo (JP); Masayuki Kozuka, Tokyo (JP)

(73) Assignee: NIPPON YUSEN KABUSHIKI KAISHA, Tokyo (JP)

( * ) Notice: Subject to any disclaimer, the term of this patent is extended or adjusted under 35 U.S.C. 154(b) by 223 days.

(21) Appl. No.: 15/565,815

(22) PCT Filed: Apr. 14, 2015

(86) PCT No.: PCT/JP2015/061450
§ 371 (c)(1),
(2) Date: Oct. 11, 2017

(87) PCT Pub. No.: WO2016/166812
PCT Pub. Date: Oct. 20, 2016

(65) Prior Publication Data

US 2018/0118312 A1 May 3, 2018

(51) Int. Cl.
*G06F 19/00* (2018.01)
*B63B 49/00* (2006.01)

(52) U.S. Cl.
CPC ..... *B63B 49/00* (2013.01)

(58) Field of Classification Search
CPC ..... B63B 49/00
(Continued)

(56) References Cited

U.S. PATENT DOCUMENTS

2013/0144670 A1* 6/2013 Kickbusch ..... G06Q 10/06 705/7.12
2014/0350989 A1* 11/2014 Telatar ..... G06Q 10/20 705/7.21
2015/0088346 A1* 3/2015 Lee ..... B63B 9/001 701/21

FOREIGN PATENT DOCUMENTS

JP 2002183341 A 6/2002
JP 2002221076 A 8/2002
(Continued)

OTHER PUBLICATIONS

Notification of Reasons for Rejection issued in corresponding Japanese Patent Application No. 2016-507950, dated Feb. 9, 2017, pp. 1-2.

(Continued)

*Primary Examiner* — Ronnie M Mancho
(74) *Attorney, Agent, or Firm* — MKG, LLC

(57) ABSTRACT

A first unit acquires attribute record data and a second unit acquires deterioration degree data from a terminal device mounted on a ship. The attribute record data indicates an attribute relating to a past sailing of the ship. The deterioration degree data indicates a deterioration degree, which is checked during performance of maintenance work, of each device mounted on the ship. A third unit generates relational data indicating a relation between various attributes relating to the state of the sailing of the ship and the deterioration degree of the device based on the attribute record data and deterioration degree data. A fourth unit acquires estimated attribute data indicating an estimated value of the attributes relating to sailing of the ship. A fifth unit generates timing data indicating a timing of maintenance work to be performed on each device based on the attribute record data, estimated attribute data, and relational data.

16 Claims, 7 Drawing Sheets

(58) Field of Classification Search
USPC ..... 701/29
See application file for complete search history.

(56) References Cited

FOREIGN PATENT DOCUMENTS

| | | | |
|---|---|---|---|
| JP | 2002234483 | A | 8/2002 |
| JP | 2007206007 | A | 8/2007 |
| JP | 2009078709 | A | 4/2009 |
| SE | 518841 | C2 | 11/2002 |

OTHER PUBLICATIONS

International Search Report issued in corresponding PCT Application No. PCT/JP2015/061450, dated May 27, 2015.
Danish Search Report issued in corresponding Danish Patent Application No. PA 2017 00606, dated Dec. 12, 2019.

* cited by examiner

| PERIOD OF TIME | SEA AREA/SEA |
|---|---|
| DECEMBER 23, 2014 15:35 TO DECEMBER 25, 2014 13:13 | PORT A |
| DECEMBER 25, 2014 13:13 TO DECEMBER 25, 2014 22:53 | SEA AREA S |
| ⋮ | ⋮ |

| PERIOD OF TIME | BOW DRAFT | CENTER DRAFT | STERN DRAFT |
|---|---|---|---|
| DECEMBER 24, 2014 11:53 TO DECEMBER 27, 2014 19: 20 | 5.38m | 6.46m | 7.80m |
| ⋮ | ⋮ | ⋮ | ⋮ |

| PERIOD OF TIME | WIND SPEED | WIND DIRECTION | CURRENT SPEED | CURRENT DIRECTION |
|---|---|---|---|---|
| DECEMBER 26, 2014 10:50 TO DECEMBER 26, 2014 11:00 | 15.2m/s | NNE | 0.56knot | NW |
| ⋮ | ⋮ | ⋮ | ⋮ | ⋮ |

| WAVE HEIGHT | WAVE DIRECTION | WAVE PERIOD | WATER TEMPERATURE | ATMOSPHERIC TEMPERATURE |
|---|---|---|---|---|
| 1.48m | NNE | 3.2s | 28.7°C | 34.3°C |
| ⋮ | ⋮ | ⋮ | ⋮ | ⋮ |

FIG. 7

| PERIOD OF TIME | OIL SUPPLY LOCATION | SELLER | OIL TYPE |
|---|---|---|---|
| DECEMBER 25, 2014 13:13 TO DECEMBER 28, 2014 23:53 | PORT P | COMPANY X | FUEL OIL C |
| ⋮ | ⋮ | ⋮ | ⋮ |

| VISCOSITY | SULFUR CONTENT | SILICA CONTENT | ALUMINA CONTENT |
|---|---|---|---|
| 328.4 | 3.2% | 215.8 ppm | 70.3 ppm |
| ⋮ | ⋮ | ⋮ | ⋮ |

FIG. 8

| PERIOD OF TIME | SHIP SPEED OVER GROUND | SHIP SPEED THROUGH WATER | PROPELLER SLIP |
|---|---|---|---|
| DECEMBER 26, 2014 10:50 TO DECEMBER 26, 2014 11:00 | 8.52knot | 7.86knot | 4.8% |
| ⋮ | ⋮ | ⋮ | ⋮ |

FIG. 9

| PERIOD OF TIME | NUMBER OF ROTATIONS | LOAD | INTAKE TEMPERATURE | EXHAUST TEMPERATURE | CYLINDER LUBRICATION AMOUNT |
|---|---|---|---|---|---|
| DECEMBER 26, 2014 10:50 TO DECEMBER 26, 2014 11:00 | 85.2 rpm | 34.8% | 40.5℃ | 264.1℃ | 1.7 g/kwh |
| ⋮ | ⋮ | ⋮ | ⋮ | ⋮ | ⋮ |

| DATE AND TIME | DEVICE NAME | PART NAME | MAINTENANCE WORK NAME | DETERIORATION DEGREE |
|---|---|---|---|---|
| SEPTEMBER 23, 2014 13:45 | MAIN ENGINE | ENGINE OIL | FULL REPLACEMENT | 70% |
| ⋮ | ⋮ | ⋮ | ⋮ | ⋮ |

| PORT OR SAILING SECTION | PERIOD OF TIME | DISPLACEMENT | USED FUEL OIL TYPE | SUPPLEMENTARY FUEL OIL TYPE | SELLER | SUPPLEMENTARY FUEL OIL AMOUNT |
|---|---|---|---|---|---|---|
| PORT A | DECEMBER 23, 2014 15:00 TO DECEMBER 25, 2014 13:00 | 21,500t | — | FUEL OIL A | COMPANY X | 350mt |
| PORT A TO PORT B | DECEMBER 25, 2014 13:00 TO DECEMBER 28, 2014 18:00 | 26,800t | FUEL OIL A | — | — | — |
| ⋮ | ⋮ | ⋮ | ⋮ | ⋮ | ⋮ | ⋮ |

FIG. 13

| REPAIRER | PORT | DEVICE TYPE | PARTS TYPE | MAINTENANCE WORK NAME | DAYS REQUIRED | REQUEST TIMING |
|---|---|---|---|---|---|---|
| COMPANY K | PORT A | BOILER | STRAINER | FILTER REPLACEMENT | ONE DAY | ONE YEAR TO ONE MONTH PREVIOUSLY |
| ⋮ | ⋮ | ⋮ | ⋮ | ⋮ | ⋮ | ⋮ |

FIG. 14

| DEVICE NAME | PARTS NAME | MAINTENANCE WORK NAME | PERIOD OF TIME | PORT NAME |
|---|---|---|---|---|
| SECOND BOILER | STRAINER | FILTER REPLACEMENT | JANUARY 25, 2015 TO MARCH 18, 2015 | PORT C PORT D |
| ⋮ | ⋮ | ⋮ | ⋮ | ⋮ |

FIG. 15

DEVICE, PROGRAM AND RECORDING MEDIUM FOR ASSISTING MAINTENANCE OF MARINE EQUIPMENT

TECHNICAL FIELD

The present invention relates to a technique for determining a timing of maintenance work performed on a device mounted on a ship.

BACKGROUND

For an industrial device, a timing at which maintenance work should be performed is usually determined by a manufacturer of the device. For example, a timing of maintenance work performed on a piston of an engine is determined such that the maintenance work should be performed after every 12,000 hours of operation time of the engine.

Additionally, a degree of deterioration of a device is influenced by the magnitude of a load applied to the device during operation. Thus, a technique is proposed to determine a timing at which maintenance work should be performed on a device to reflect the magnitude of a load applied to the device.

For example, Japanese Patent Application Publication No. JP2007-206007A proposes a technique for determining an exact timing to replace parts of a machine based on a use time that is calculated to reflect the magnitude of a load applied to the machine under use.

For a device mounted on a ship, a timing at which maintenance work should be performed is also usually determined by a manufacturer of the devices. However, a degree of deterioration of such a device mounted on a ship is influenced by, in addition to the magnitude of a load applied to the device and an operation time of the device, various factors such as a ship speed, an attitude of the ship, a meteorological or hydrographic phenomenon that the ship has encountered during sailing, and a type of fuel oil used by a main engine.

In view of the foregoing, it is an object of the present invention to provide a means for enabling determination of a timing of maintenance work to be performed on a device mounted on a ship.

SUMMARY OF THE INVENTION

To solve the foregoing problem, according to the present invention a device is provided that includes: an attribute-record-data-acquisition unit configured to acquire attribute record data indicating a record of at least one attribute recorded during past sailing of a ship, the at least one attribute relating to a state of sailing of the ship; a deterioration-degree-data-acquisition unit configured to acquire deterioration degree data indicating a deterioration degree of a device mounted on the ship, the deterioration degree being determined during performance of maintenance work on the device; and a relational-data-generation unit configured to generate relational data indicating a relation between the at least one attribute indicated by the attribute record data acquired by the attribute-record-data-acquisition unit and the deterioration degree indicated by the deterioration degree data acquired by the deterioration-degree-data-acquisition unit.

In the above device, the at least one attribute may include at least one of the number of port calls by the ship, a route of sailing of the ship, a meteorological phenomenon or hydrographic phenomenon that the ship has encountered during sailing, an attitude of the ship, and a characteristic of fuel oil used by a main engine of the ship.

According to the present invention, a device is also provided that includes: a relational-data-acquisition unit configured to acquire relational data indicating a relation between at least one attribute relating to a state of sailing of a ship and a deterioration degree of a device mounted on the ship; an attribute-record-data-acquisition unit configured to acquire attribute record data indicating a record of the at least one attribute recorded during past sailing of the ship; an estimated-attribute-data-acquisition unit configured to acquire estimated attribute data indicating the at least one attribute estimated for sailing of the ship; and a timing-data-generation unit configured to generate timing data indicating a timing of maintenance work to be performed on the device based on the relational data acquired by the relational-data-acquisition unit, the attribute record data acquired by the attribute-record-data-acquisition unit, and the estimated attribute data acquired by the estimated-attribute-data-acquisition unit.

In the above device, the estimated-attribute-data-acquisition unit may estimate the at least one attribute for sailing of the ship based on a record of the at least one attribute recorded during past sailing of the ship, the record being indicated by the attribute record data acquired by the attribute-record-data-acquisition unit, and may generate and acquire estimated attribute data indicating the at least one estimated attribute.

The above device may further include a sailing-schedule-data-acquisition unit configured to acquire sailing schedule data indicating a sailing schedule of the ship; and a maintenance-schedule-data-generation unit configured to generate maintenance schedule data indicating a timing and location of maintenance work to be performed on the device based on the timing data generated by the timing-data-generation unit and the sailing schedule data acquired by the sailing-schedule-data-acquisition unit.

In the above device, the at least one attribute may include at least one of the number of port calls by the ship, a route of sailing of the ship, a meteorological phenomenon or hydrographic phenomenon that the ship has encountered during sailing, an attitude of the ship, and a characteristic of fuel oil used by a main engine of the ship.

The present invention further provides a program that causes a computer to execute: a process of acquiring attribute record data indicating a record of at least one attribute recorded during past sailing of a ship, the at least one attribute relating to a state of sailing of the ship; a process of acquiring deterioration degree data indicating a deterioration degree of a device mounted on the ship, the deterioration degree being determined during performance of maintenance work on the device; and a process of generating relational data indicating a relation between the at least one attribute indicated by the attribute record data and the deterioration degree indicated by the deterioration degree data.

The present invention still further provides a program that causes a computer to execute: a process of acquiring relational data indicating a relation between at least one attribute relating to a state of sailing of a ship and a deterioration degree of a device mounted on the ship; a process of acquiring attribute record data indicating a record of the at least one attribute recorded during past sailing of the ship; a process of acquiring estimated attribute data indicating the at least one attribute estimated for sailing of the ship; and a process of generating timing data indicating a timing of maintenance work to be performed on the device based on the relational data, the attribute record data, and the estimated attribute data.

The present invention still further provides a non-transitory computer readable recording medium recording a program that causes a computer to execute: a process of acquiring attribute record data indicating a record of at least one attribute recorded during past sailing of a ship, the at least one attribute relating to a state of sailing of the ship; a process of acquiring deterioration degree data indicating a deterioration degree of a device mounted on the ship, the deterioration degree being determined during performance of maintenance work on the device; and a process of generating relational data indicating a relation between the at least one attribute indicated by the attribute record data and the deterioration degree indicated by the deterioration degree data.

The present invention still further provides a non-transitory computer readable recording medium recording a program that causes a computer to execute: a process of acquiring relational data indicating a relation between at least one attribute relating to a state of sailing of a ship and a deterioration degree of a device mounted on the ship; a process of acquiring attribute record data indicating a record of the at least one attribute recorded during past sailing of the ship; a process of acquiring estimated attribute data indicating the at least one attribute estimated for sailing of the ship; and a process of generating timing data indicating a timing of maintenance work to be performed on the device based on the relational data, the attribute record data, and the estimated attribute data.

According to the present invention, a relation between an attribute relating to a state of sailing of a ship and a deterioration degree of a device is determined based on an attribute recorded in past sailing of the ship and a deterioration degree determined during performance of past maintenance work, and then a timing of maintenance work for to be performed on the device is determined based on the relation. Thus, a timing of maintenance work to be performed on a device mounted on a ship is determined.

BRIEF DESCRIPTION OF DRAWINGS

FIG. 7 is a diagram showing an exemplary structure of a meteorological-or-hydrographic-phenomenon-record table used in the maintenance management system according to an embodiment.

FIG. 8 is a diagram showing an exemplary structure of a main-engine-fuel-oil-record table used in the maintenance management system according to an embodiment.

FIG. 9 is a diagram showing an exemplary structure of a ship-speed-record table used in the maintenance management system according to an embodiment.

FIG. 13 is a diagram showing an exemplary structure of sailing schedule data used in the maintenance management system according to an embodiment.

FIG. 14 is a diagram showing an exemplary structure of maintenance constraint data used in the maintenance management system according to an embodiment.

FIG. 15 is a diagram showing an exemplary structure of a maintenance schedule table used in the maintenance management system according to an embodiment.

DETAILED DESCRIPTION

Maintenance management system 1 according to an embodiment of the present invention will be described below. Maintenance management system 1 is used to manage a timing of maintenance work to be performed on a device mounted on a ship. Note that the "device" means the subject of maintenance work in the present application. For example, when a certain device includes a plurality of parts each subject to separate maintenance work, each of the parts is referred to as the "device" accordingly.

Figure 1:
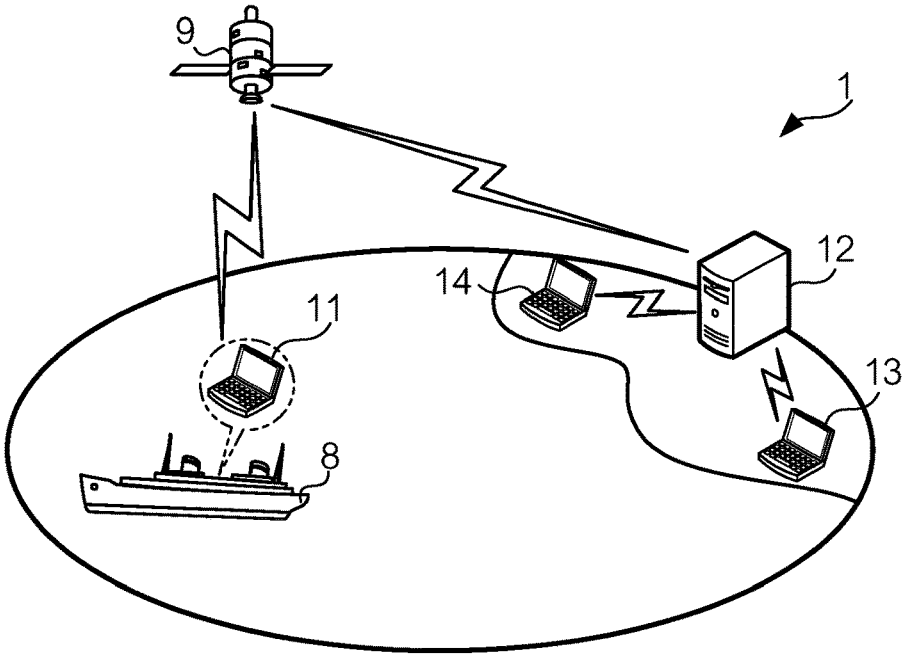
FIG. 1 is a diagram showing an overall structure of a maintenance management system according to an embodiment.

FIG. 1 is a diagram showing an overall structure of maintenance management system 1 according to an embodiment. Maintenance management system 1 includes terminal device 11 provided on ship 8, server device 12 that sends/receives data to/from terminal device 11 via communication satellite 9, server device 13 that distributes to server device 12 meteorological or hydrographic phenomenon data indicating a meteorological or hydrographic phenomenon that ship 8 has encountered during sailing, and terminal device 14. Terminal device 14 is used by a user such as a staff member of a management company of ship 8 to view data stored in server device 12. Although in FIG. 1 only one ship 8 and one terminal device 11 are shown, the number of ships 8 and terminal devices 11 varies depending on various factors, such as the number of ships for which maintenance management system 1 manages a timing of maintenance work. Additionally, although in FIG. 1 only one terminal device 14 is shown, the number of terminal devices 14 varies depending on a number of users, such as staff members of a management company, who view data using maintenance management system 1. Furthermore, although in FIG. 1 terminal device 14 is shown as being located on land, a location of terminal device 14 is not limited to land.

Figure 2:
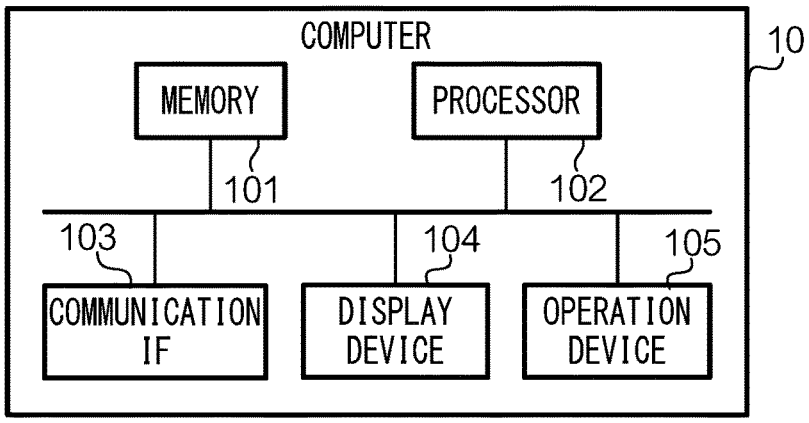
FIG. 2 is a diagram showing basic components of a computer employed as hardware of a terminal device according to an embodiment.

Terminal device 11 and terminal device 14 each have hardware components, for example, that are the same as those of a computer for a general terminal device. FIG. 2 is a diagram showing basic components of computer 10 employed as hardware of each of terminal device 11 and terminal device 14. Computer 10 includes: memory 101 that stores various data; processor 102 that performs various data processing in accordance with a program stored in memory 101; communication interface (IF) 103 that serves as an interface performing data communications with other devices; display device 104, such as a liquid crystal display, that displays images to a user; and operation device 105, such as a keyboard, that receives operations input by the user. Note that instead of or in addition to display device 104 incorporated in computer 10, an external display device, which is connected to computer 10, may be used. Similarly, instead of or in addition to operation device 105 incorporated in computer 10, an external operation device, which is connected to computer 10, may be used.

Figure 3:
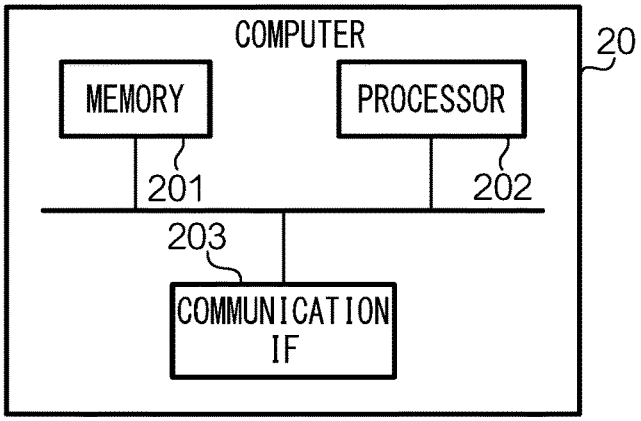
FIG. 3 is a diagram showing basic components of a computer employed as hardware of a server device according to an embodiment.

Server device 12 and server device 13 each have hardware components, for example, that are the same as those of a computer for a general server device. FIG. 3 is a diagram showing basic components of computer 20 employed as a hardware of server device 12 or server device 13. Computer 20 includes: memory 201 that stores various data; processor 202 that performs various data processing in accordance with a program stored in memory 201; and communication IF 203 that sends/receives data to/from other devices.

Figures 4, 5, 6:
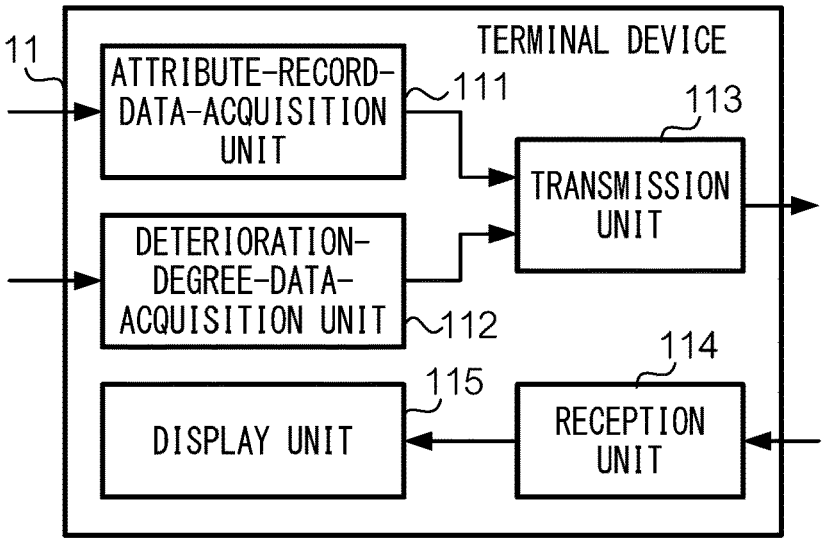
FIG. 4 is a diagram showing functional components of the terminal device according to an embodiment.
FIG. 5 is a diagram showing an exemplary structure of a route record table used in the maintenance management system according to an embodiment.
FIG. 6 is a diagram showing an exemplary structure of an attitude record table used in the maintenance management system according to an embodiment.

FIG. 4 is a diagram showing functional components of terminal device 11. Specifically, computer 10 operates as a device including the components shown in FIG. 4 by performing data processing in accordance with a program for terminal device 11.

Terminal device 11 firstly includes attribute-record-data-acquisition unit 111 that acquires attribute record data indicating various kinds of attributes relating to a state of past or present sailing of ship 8. Some attribute record data, which is acquired by attribute-record-data-acquisition unit 111, indicates a value measured by various measuring devices provided on ship 8. This attribute record data is generated by the measuring devices and then is input into terminal device 11. Some other attribute record data is input by a user such as a crew member of ship 8. Still other attribute record data is a processing result of at least one set of attribute record data, which is acquired in the manner described above, performed by attribute-record-data-acquisition unit 111.

Additionally, some attribute record data is accompanied by period data indicating a period of time corresponding to an attribute indicated by this attribute record data. Some other attribute record data is accompanied by time data indicating a time corresponding to an attribute indicated by this attribute record data. Attribute-record-data-acquisition unit 111 includes a timer unit that measures a current time. Upon acquiring attribute record data that is accompanied by neither the period data nor the time data, attribute-record-data-acquisition unit 111 associates time data indicating the current time, which is measured by the timer unit, with this attribute record data.

Attribute-record-data-acquisition unit 111 also includes a memory unit. Attribute-record-data-acquisition unit 111 temporarily stores in the memory unit the acquired attribute record data in association with period data indicating a period of time corresponding to an attribute indicated by the acquired attribute record data. For the attribute record data associated with the time data, attribute-record-data-acquisition unit 111 specifies, for example, a representative value of attributes (e.g., an average value or intermediate value) indicated by the attribute record data corresponding to times within each period of time, which is determined by predetermined time intervals. Attribute-record-data-acquisition unit 111 then temporarily stores in the memory unit the attribute record data indicating the specified representative value in association with period data indicating the period of time.

The attribute record data, which is acquired by attribute-record-data-acquisition unit 111, includes data relating to a route sailed by ship 8, data indicating an attribute relating to an attitude of ship 8 during sailing, data indicating an attribute relating to a meteorological or hydrographic phenomenon that ship 8 has encountered during sailing, data indicating an attribute relating to fuel oil used by a main engine of ship 8, data relating to a ship speed of ship 8, and data indicating an attribute relating to an operation state of the devices mounted on ship 8.

FIGS. 5 to 10 are diagrams showing exemplary structures of tables used by attribute-record-data-acquisition unit 111 that temporarily stores the attribute record data.

FIG. 5 shows an example of a table (hereinafter referred to as "route record table") for storing the attribute record data indicating the attribute relating to the route. The route record table stores, in association with period data, attribute record data indicating a sea area in which ship 8 has sailed and a port at which ship 8 has called within a period of time indicated by the period data. Note that the data stored in the route record table enables determination of the number of port calls by ship 8 within a certain period of time.

FIG. 6 shows an example of a table (hereinafter referred to as "attitude record table") for storing the attribute record data indicating the attribute relating to the attitude of ship 8. The attitude record table stores, in association with period data, attribute record data indicating a bow draft, center draft, and stern draft of ship 8 within a period of time indicated by the period data.

FIG. 7 shows an example of a table (hereinafter referred to as "meteorological-or-hydrographic-phenomenon-record table") for storing the attribute record data indicating the attribute relating to the meteorological or hydrographic phenomenon that ship 8 has encountered. The meteorological-or-hydrographic-phenomenon-record table stores, in association with period data, attribute record data indicating a wind speed, a wind direction, a current speed, a current direction, a wave height, a wave direction, a wave period, a water temperature, and an atmospheric temperature that ship 8 has encountered within a period of time indicated by the period data.

FIG. 8 shows an example of a table (hereinafter referred to as "main-engine-fuel-oil-record table") for storing the attribute record data indicating the attribute relating to the fuel oil used by the main engine. The main-engine-fuel-oil-record table stores, in association with period data, attribute record data indicating an oil supply location, a seller, an oil type (e.g., fuel oil C or fuel oil A, which is defined by Japanese Industrial Standards, or lower sulfur fuel oil), the viscosity, the sulfur contents, the silica content, and the alumina content of the fuel oil consumed by the main engine within a period of time indicated by the period data.

FIG. 9 shows an example of a table (hereinafter referred to as "ship-speed-record table") for storing the attribute record data indicating the attribute relating to the ship speed. The ship-speed-record table stores, in association with period data, a ship speed over ground, a ship speed through water, and propeller slip of ship 8 recorded within a period of time indicated by the period data.

Figures 10, 11, 12:
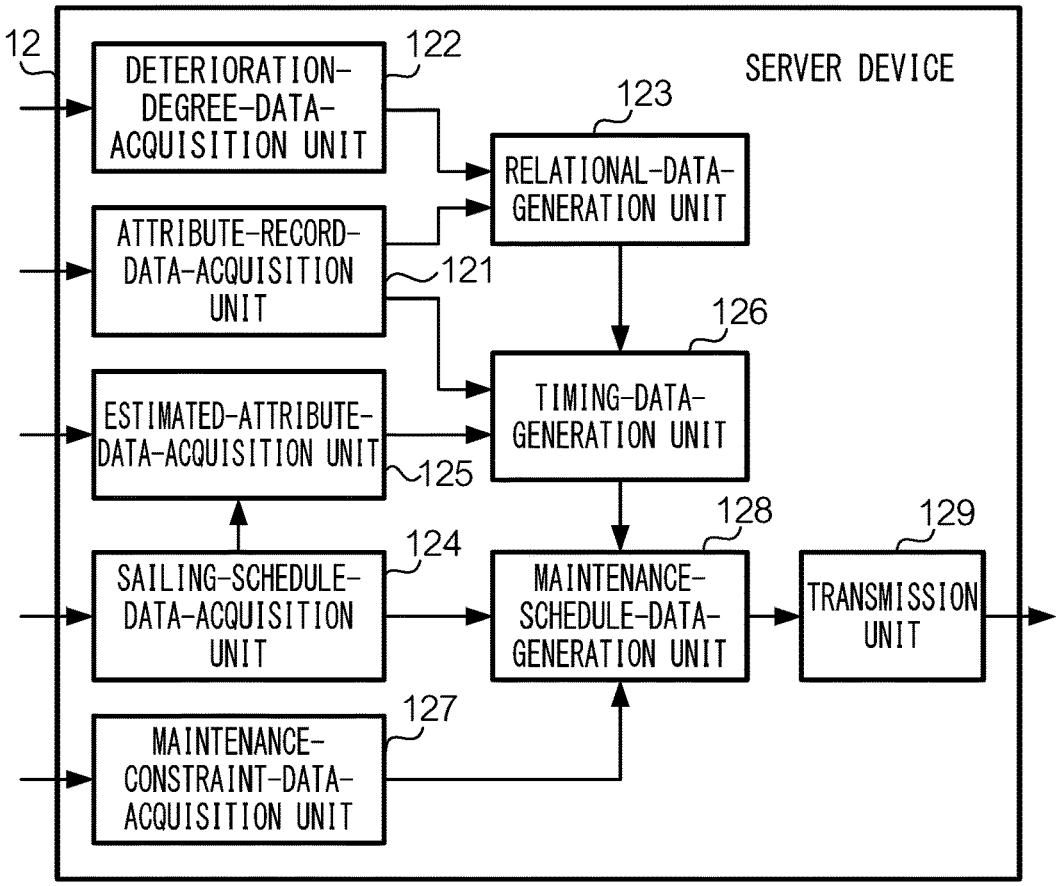
FIG. 10 is a diagram showing an exemplary structure of a main-engine-operation-record table used in the maintenance management system according to an embodiment.
FIG. 11 is a diagram showing an exemplary structure of a maintenance work table used in the maintenance management system according to an embodiment.
FIG. 12 is a diagram showing functional components of the server device according to an embodiment.

FIG. 10 shows an example of a table (hereinafter referred to as "main-engine-operation-record table") for storing the attribute record data indicating the attribute relating to the operation state of the main engine mounted on ship 8 (which is an example of a device mounted on ship 8). The main-engine-operation-record table stores, in association with period data, attribute record data indicating a number of rotations, a load, an intake temperature, an exhaust temperature, and cylinder lubrication amount of ship 8 recorded within a period of time indicated by the period data. Attribute-record-data-acquisition unit 111 also stores tables similar to the main-engine-operation-record table for various devices mounted on ship 8 other than the main engine, and stores the acquired attribute record data in the tables.

Note that the kind of data shown in FIGS. 5 to 10 is merely an example. The attribute record data, which is acquired by attribute-record-data-acquisition unit 111, may include any kind of data as long as the data indicates an attribute that relates to a state of sailing of ship 8 and that can affect the degree of deterioration of the devices mounted on ship 8.

Returning to FIG. 4, the functional components of terminal device 11 will be further described below. Terminal device 11 includes deterioration-degree-data-acquisition unit 112 that acquires deterioration degree data indicating the degree of deterioration of each device mounted on ship 8. The deterioration degree data, which is acquired by deterioration-degree-data-acquisition unit 112, indicates the degree of deterioration of the device checked by a worker during maintenance work of the device. The deterioration degree data is, for example, input by the worker. When the worker determines while performing maintenance work that the maintenance work is being performed at an appropriate timing, the worker inputs, for example, value "100" as the degree of deterioration. Meanwhile when the worker determines that the maintenance work is being performed too early, the worker inputs, for example, a value smaller than 100 as the degree of deterioration. When the worker determines that the maintenance work is being performed too late, the worker inputs, for example, a value greater than 100 as the degree of deterioration. The deterioration degree data, which is acquired by deterioration-degree-data-acquisition unit 112, is accompanied by data indicating a time when the worker checks the degree of deterioration and details of the maintenance work performed at the time.

Deterioration-degree-data-acquisition unit 112 includes a memory unit. Deterioration-degree-data-acquisition unit 112 temporarily stores in the memory unit the acquired deterioration degree data and the data accompanying the deterioration degree data. FIG. 11 is a diagram showing an exemplary structure of a table (hereinafter, referred to as "maintenance work table") used by deterioration-degree-data-acquisition unit 112 for temporarily storing the deterioration degree data. The maintenance work table stores a date and time when the worker has checked the deterioration degree, the name of the device and parts (device) that are subject to the maintenance work, data indicating the name of the maintenance work, and the deterioration degree data in association with each other.

Terminal device 11 includes transmission unit 113 that transmits to server device 12 the data acquired by attribute-record-data-acquisition unit 111 (refer to FIGS. 5 to 10) and data acquired by deterioration-degree-data-acquisition unit 112 (refer to FIG. 11). Transmission unit 113 transmits to server device 12 via communication satellite 9 the data stored in attribute-record-data-acquisition unit 111 and the data stored in deterioration-degree-data-acquisition unit 112, for example, each time a predetermined time period has passed. Note that in an example, attribute-record-data-acquisition unit 111 and deterioration-degree-data-acquisition unit 112 delete from the table memory unit the data that has been transmitted to server device 12.

Terminal device 11 also includes reception unit 114 that receives maintenance schedule data that has been transmitted from server device 12. The maintenance schedule data indicates a time and location of maintenance work (e.g., a time and location of the maintenance work that should be performed in the future) for each device mounted on ship 8.

Terminal device 11 further includes display unit 115 that displays a screen (hereinafter, referred to as "maintenance schedule screen") to present to the user information indicated by the maintenance schedule data that has been received by reception unit 114. Note that display unit 115 may include a display device to display the maintenance schedule screen by itself, or may instruct an external display device to display the maintenance schedule screen.

The functional components of terminal device 11 are as described above. The functional components of server device 12 will be described below. FIG. 12 is a diagram showing the functional components of server device 12. Specifically, computer 20 serves as a device including the components shown in FIG. 12 by executing data processing in accordance with a program for server device 12.

Server device 12 firstly includes attribute-record-data-acquisition unit 121 that receives the attribute record data that has been transmitted from terminal device 11 together with the period data, and deterioration-degree-data-acquisition unit 122 that receives the deterioration degree data that has been transmitted from terminal device 11 together with the data indicating the date and time and other characteristics.

Server device 12 also includes relational-data-generation unit 123 that generates relational data indicating a relation between the attribute indicated by the attribute record data and the deterioration degree indicated by the deterioration degree data for each device mounted on ship 8 by using the data (including the attribute record data) acquired by attribute-record-data-acquisition unit 121 and the data (including the deterioration degree data) acquired by deterioration-degree-data-acquisition unit 122.

Relational-data-generation unit 123 includes a memory unit to store in the memory unit data previously acquired from attribute-record-data-acquisition unit 121 and data previously acquired from deterioration-degree-data-acquisition unit 122. Relation relational-data-generation unit 123 determines a relational formula indicating the relation between various attributes and the deterioration degree for each device according to a well-known statistical method by using the data stored in the memory unit. For example, it may be assumed that relational-data-generation unit 123 performs a regression analysis using the degree of deterioration indicated by the deterioration degree data as an objective variable, and using various attributes indicated by the attribute record data as an explanatory variable. Relational-data-generation unit 123 then calculates their relation as a "deterioration degree formula." Data indicating the deterioration degree formula is one example of the relational data.

Server device 12 includes sailing-schedule-data-acquisition unit 124 that acquires sailing schedule data indicating a sailing schedule of ship 8. The sailing schedule data, which is acquired by sailing-schedule-data-acquisition unit 124, is input by, for example, an operation manager of ship 8.

FIG. 13 is a diagram showing an exemplary structure of the sailing schedule data acquired by sailing-schedule-data-acquisition unit 124. The sailing schedule data includes data fields "port or sailing section," "period of time," "displacement," "used fuel oil type," "supplementary fuel oil type," "seller," and "supplementary fuel oil amount" in a table format. The data field "port or sailing section" stores the name of a port to be called at by ship 8 or the name of a sailing section where ship 8 is to sail. The data field "period of time" stores data indicating a period of time during which ship 8 is to be anchored at the port indicated by the data in the data field "port or sailing section," or data indicating a period of time during which ship 8 is to sail the sailing section indicated by the data in the data field "port or sailing section."

The data field "displacement" stores data indicating displacement of ship 8 (amount of water to be displaced by ship 8) while ship 8 sails the sailing section indicated by the data in the data field "port or sailing section." The data field "used fuel oil type" stores the name of an oil type of fuel oil to be used while ship 8 sails the sailing section indicated by the data in the data field "port or sailing section." The data field "supplementary fuel oil type" stores the name of an oil type of the fuel oil to be supplied at the port indicated by the data in the data field "port or sailing section." The data field "seller" stores the name of a seller of the fuel oil to be supplied at the port indicated by the data in the data field "port or sailing section." The data field "supplementary fuel oil amount" stores data indicating the amount of a supplementary fuel oil to be supplied at the port indicated by the data in the data field "port or sailing section" with fuel oil that is of the name indicated by the data in the data field "supplementary fuel oil type."

Server device 12 includes estimated-attribute-data-acquisition unit 125 that acquires estimated attribute data indicating various attributes estimated for sailing of ship 8. The kinds of attributes indicated by the estimated attribute data, which is acquired by estimated-attribute-data-acquisition unit 125, are the same kinds of attributes indicated by the attribute record data acquired by attribute-record-data-acquisition unit 121. The structure of the estimated attribute data, which is acquired by estimated-attribute-data-acquisition unit 125, is similar to that exemplarily shown in FIGS. 5 to 10, accordingly.

The estimated attribute data, which is acquired by estimated-attribute-data-acquisition unit 125, includes data acquired from server device 12 and data acquired by estimated-attribute-data-acquisition unit 125 generating this data. Estimated-attribute-data-acquisition unit 125 includes a memory unit to store the acquired data in the memory unit.

Estimated-attribute-data-acquisition unit 125 generates estimated attribute data relating to the route based on the sailing schedule data (refer to FIG. 13). For example, estimated-attribute-data-acquisition unit 125 acquires the sailing schedule data from sailing-schedule-data-acquisition unit 124. Estimated-attribute-data-acquisition unit 125 then determines a port to be called at by ship 8 and a period of time during which ship 8 is to be anchored at the port, and a sea area where ship 8 is to sail and a period of time during which ship 8 is to sail the sea area when ship 8 sails according to the sailing schedule indicated by the sailing schedule data. Estimated-attribute-data-acquisition unit 125 stores data indicating the result of determination as the estimated attribute data relating to the route of ship 8 in a table (hereinafter, referred to as "estimated route table"), which has a structure similar to that of the table shown in FIG. 5.

Estimated-attribute-data-acquisition unit 125 also generates estimated attribute data relating to the attitude of ship 8 based on the sailing schedule data (refer to FIG. 13). For example, estimated-attribute-data-acquisition unit 125 estimates an amount of fuel consumption when ship 8 sails according to the sailing schedule indicated by the sailing schedule data. Estimated-attribute-data-acquisition unit 125 then estimates the bow draft, center draft, and stern draft of ship 8 within each period of time based on the displacement and supplementary fuel oil amount that are indicated by the sailing schedule data, and on the estimated amount of fuel consumption. Estimated-attribute-data-acquisition unit 125 stores data indicating the result of estimation as the estimated attribute data relating to the attitude of ship 8 in a table (hereinafter, referred to as "estimated attitude table"), which has a structure similar to that of the table shown in FIG. 6.

Estimated-attribute-data-acquisition unit 125 further acquires from server device 13 estimated attribute data relating to the meteorological or hydrographic phenomenon. For example, estimated-attribute-data-acquisition unit 125 acquires from server device 13 meteorological or hydrographic phenomenon data relating to the date and time and sea area that are indicated by the estimated attribute data relating to the route, and stores the acquired meteorological or hydrographic phenomenon data in a table (hereinafter referred to as "estimated meteorological/hydrographic phenomenon table"), which has a structure similar to that of the table shown in FIG. 7.

Estimated-attribute-data-acquisition unit 125 further generates estimated attribute data relating to the fuel oil of the main engine based on the attribute record data. For example, estimated-attribute-data-acquisition unit 125 determines a representative value of the attribute (e.g., the mode of the oil type, or the average viscosity of the fuel oil of an oil type corresponding to the mode) indicated by the attribute record data relating to the fuel oil that has been supplied previously at the oil supply location on the route indicated by the estimated attribute data relating to the route. Estimated-attribute-data-acquisition unit 125 then stores the determined representative value as the estimated attribute data relating to the fuel oil of the main engine in a table (hereinafter, referred to as "estimated-main-engine-fuel-oil table"), which has a structure similar to that of the table shown in FIG. 8.

Estimated-attribute-data-acquisition unit 125 further generates estimated attribute data relating to the ship speed based on the sailing schedule data and attribute record data. For example, estimated-attribute-data-acquisition unit 125 calculates the ship speed over ground of ship 8 within each period of time when ship 8 sails according to the sailing schedule indicated by the sailing schedule data. Estimated-attribute-data-acquisition unit 125 then estimates a propeller slip when ship 8 sails at the calculated ship speed over ground under the meteorological or hydrographic phenomenon indicated by the estimated attribute data relating to the meteorological or hydrographic phenomenon, based on the propeller slip indicated by the attribute record data relating to the ship speed at which ship 8 has sailed previously under an identical or similar condition. Estimated-attribute-data-acquisition unit 125 then estimates a ship speed through water of ship 8 based on the ship speed over ground calculated in the above manner and on the propeller slip estimated in the above manner. Estimated-attribute-data-acquisition unit 125 stores data indicating the ship speed over ground, ship speed through water, and propeller slip, which are calculated or estimated in the above manner, as the estimated attribute data relating to the ship speed in a table (hereinafter, referred to as "estimated ship speed table"), which has a structure similar to that of the table shown in FIG. 9.

Estimated-attribute-data-acquisition unit 125 further generates estimated attribute data relating to the operation state of each device mounted on ship 8. In the following example it is assumed that estimated attribute data relating to the operation state of the main engine is used. In this example, estimated-attribute-data-acquisition unit 125 estimates, for example, the number of rotations, a load, an intake temperature, and an exhaust temperature of the main engine within each period of time based on the estimated attribute data relating to the meteorological or hydrographic phenomenon, the estimated attribute data relating to the ship speed, and so forth. Estimated-attribute-data-acquisition unit 125 also estimates, for example, an amount of cylinder lubricant within each period of time based on past amounts of cylinder lubricant indicated by the attribute record data relating to the operation state of the main engine. Estimated-attribute-data-acquisition unit 125 stores data of the operation state such as the number of rotations, which is estimated in the above manner, as the estimated attribute data relating to the operation state of the main engine, in a table (hereinafter, referred to as "estimated-main-engine-operation table"), which has a structure similar to that of the table shown in FIG. 10.

Note that estimated-attribute-data-acquisition unit 125 deletes a data record corresponding to an already-passed time that is indicated by time data from data records in the stored table (e.g., the estimated route table) as time passes.

Returning to FIG. 12 again, the functional components of server device 12 will be further described below. Server device 12 includes timing-data-generation unit 126 that generates timing data indicating a timing of maintenance work to be performed on each device mounted on ship 8 based on the relational data generated by relational data generating unit 123, the attribute record data acquired by attribute-record-data-acquisition unit 121, and the estimated attribute data acquired by estimated-attribute-data-acquisition unit 125.

More specifically, timing-data-generating unit 126 specifies a date and time of the most recently performed maintenance work (hereinafter, referred to as "last maintenance date and time $t_s$") for each device mounted on ship 8, which is indicated in the maintenance operation table (refer to FIG. 11). Timing-data-generation unit 126 then extracts a data record corresponding to a date and time on or after the last maintenance date and time $t_s$ from data records included in the tables (e.g., the route record table) stored in attribute-record-data-acquisition unit 121.

Timing-data-generation unit 126 then determines a representative value of the attribute value (e.g., an average value or a mode) corresponding to a period of time from the last maintenance date and time $t_s$ to a certain future date and time $t_e$ based on the attribute value indicated by the data record corresponding to the date and time on or after the last maintenance date and time $t_s$, which is extracted from the table stored in attribute-record-data-acquisition unit 121, and the attribute value indicated by the data record in the table (e.g., the estimated route table.) stored in estimated-attribute-data-acquisition unit 125. Timing-data-generation unit 126 then calculates an estimated value of the deterioration degree of the device (hereinafter, referred to as "estimated deterioration degree $D(t_e)$") at date and time $t_e$ by substituting the representative value of the attribute value corresponding to the date and time from the last maintenance date and time $t_s$ to the certain future date and time $t_e$ for the deterioration degree formula generated by relational-data-generation unit 123 as the explanatory variable.

Timing-data-generation unit 126 repeatedly calculates estimated deterioration degree $D(t_e)$ while changing date and time $t_e$, and then determines a range of date and time $t_e$ such that estimated deterioration degree $D(t_e)$ falls within a predetermined threshold range (e.g., "90 to 100") as a timing for performing the maintenance work on the device. Timing-data-generation unit 126 generates timing data indicating the determined timing.

Server device 12 includes maintenance-constraint-data-acquisition unit 127 for acquiring maintenance constraint data indicating a constraint of maintenance work performed on each device mounted on ship 8 from, for example, a terminal device (not shown in FIG. 1) of a repairer who performs maintenance work at a particular port. Maintenance-constraint-data-acquisition unit 127 stores and manages the maintenance constraint data that has been transmitted from the terminal device of the repairer in a table (hereinafter, referred to as "maintenance constraint table").

FIG. 14 is a diagram showing an exemplary structure of the maintenance constraint table. The maintenance constraint table is a collection of data records, each corresponding to a set of a repairer and a type of device subject to the maintenance work. The maintenance constraint table includes: data field "repairer" that stores data identifying the repairer; data field "port" that stores data identifying a port where maintenance work is performed; data fields "device type" and "parts type" that each store data identifying the device subject to the maintenance work; data field "maintenance work name" that stores the name of the maintenance work; data field "days required" that stores the number of days required to perform the maintenance work; and data field "request timing" that stores a condition relating to timing of a request for the maintenance work (e.g., where a request is required to be made one month in advance).

Note that when newly received maintenance constraint data indicates the repairer, port, device type, parts type, and maintenance work name that are the same as those indicated by the maintenance constraint data that is already stored in the maintenance constraint table, maintenance-constraint-data-acquisition unit 127 overwrites the old maintenance constraint data with the newly received maintenance constraint data.

Returning to FIG. 12 again, the functional components of server device 12 will be further described below. Server device 12 includes maintenance-schedule-data-generation unit 128 that determines a timing and location of the maintenance work to be performed on the device based on the timing data, sailing schedule data, and maintenance constraint data, and then generating maintenance schedule data indicating the determined timing and location.

Specifically, maintenance-schedule-data-generation unit 128 determines, for each device mounted on ship 8, at least one port where ship 8 can call at the timing indicated by the timing data, which is generated by timing-data-generating unit 126, and where the maintenance work can be performed, based on the sailing schedule data and maintenance constraint data. Maintenance-schedule-data-generation unit 128 then generates maintenance schedule data indicating the determined port and a period of time during which ship 8 is to be anchored at this port.

Maintenance-schedule-data-generation unit 128 stores the generated maintenance schedule data in a table (hereinafter, referred to as "maintenance schedule table"). FIG. 15 is a diagram showing an exemplary structure of the maintenance schedule table. The maintenance schedule table is a collection of data records, each corresponding to the device subject to the maintenance work. The maintenance schedule table includes: data fields "device name" and "parts name" that each store data identifying the device; data field "maintenance work name" that stores the name of the maintenance work; data field "period of time" that stores data indicating a period of time during which the maintenance work should be performed; and data field "port name" that stores data indicating a location where the maintenance work should be performed.

Note that upon generating new maintenance schedule data for a certain device, maintenance-schedule-data-generation unit 128 overwrites data in a data record corresponding to this device in the maintenance schedule table with the newly generated data.

Server device 12 also includes transmission unit 129 that transmits to terminal device 11 the maintenance schedule data generated by maintenance-schedule-data-generation unit 128. Transmission unit 129 transmits to terminal device 11 via communication satellite 9 the maintenance schedule data stored in maintenance-schedule-data-generation unit 128, for example, at predetermined time intervals.

The functional components of server device 12 are as described above. The functional components of server device 13 are the same as the functional components of a general server device that distributes data to a requester in response to a request, and therefore description of the functional components of server device 13 is omitted. The functional components of terminal device 14 are the same as the functional components of a general terminal device that requests data from the server device and then displays data that has been transmitted in response to the request, and therefore description of the functional components of terminal device 14 is omitted.

Figure 16:
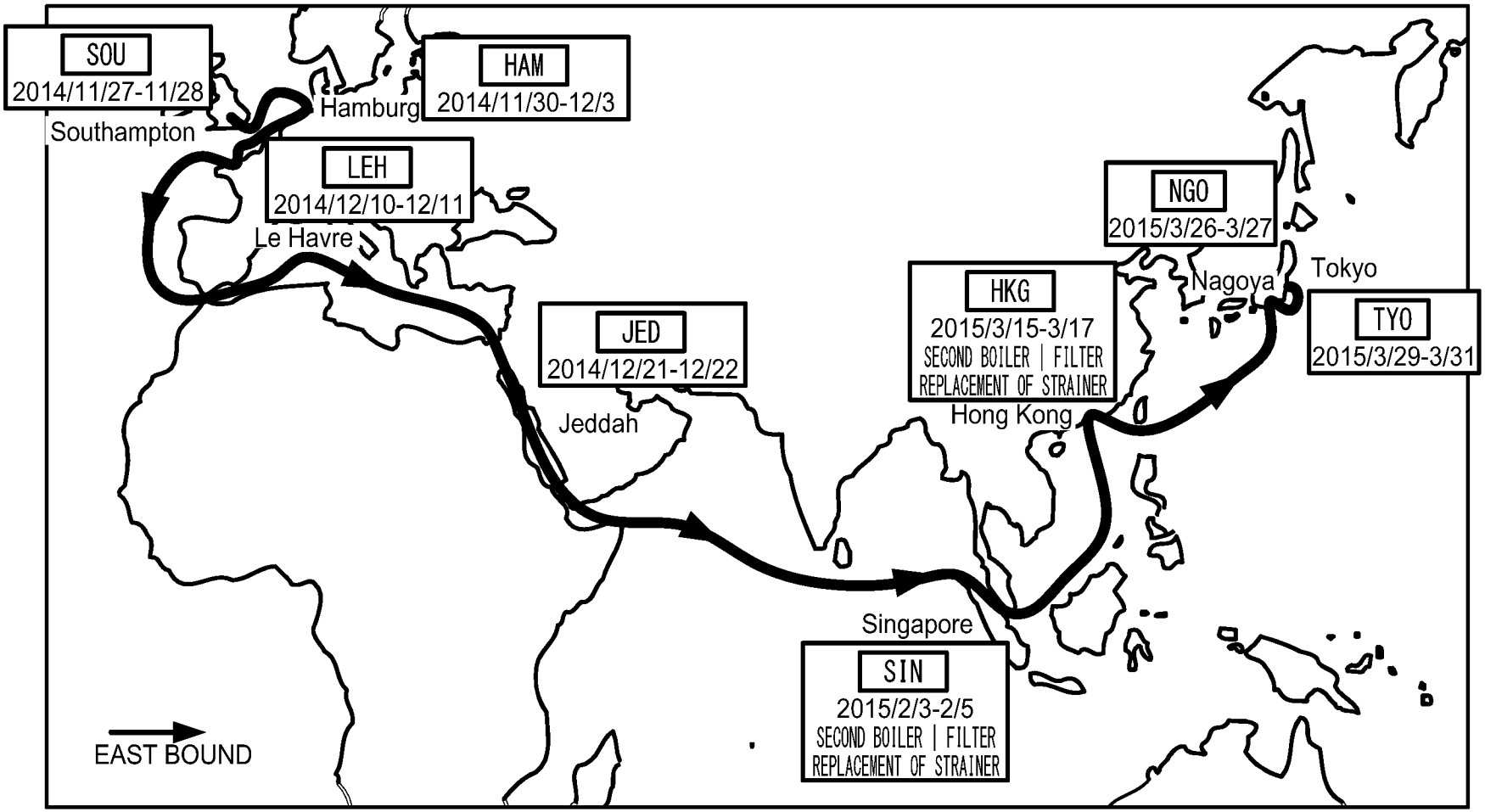
FIG. 16 is a diagram showing an example of a maintenance schedule screen displayed on the terminal device according to an embodiment.

Terminal device 11 displays the maintenance schedule screen by display unit 115 upon receiving the maintenance schedule table that has been transmitted from server device 12. FIG. 16 is a diagram showing an example of the maintenance schedule screen. The maintenance schedule screen shows the sailing schedule of ship 8 with a period of time for anchorage at each port of call. The maintenance schedule screen also shows the name of the device subject to the maintenance work that should be performed at each port of call. The maintenance schedule screen allows a user such as a worker of ship 8 to understand the desired timing and location of maintenance work to be performed on each of various devices.

As described above, according to maintenance management system 1, the timing at which maintenance work should be performed on each device mounted on ship 8 is presented to the user. This timing of maintenance work presented to the user is determined so as to reflect the influence of the various attributes relating to the state of sailing of ship 8. Thus, the user is able to understand more appropriate timings of performance of maintenance work, compared to the case where the influence of those attributes is not reflected. Additionally, according to maintenance management system 1, a location where the maintenance work of the device mounted on ship 8 should be performed is presented to the user. This allows the user, for example, to arrange in advance delivery of replacement parts required for the maintenance work to the port where the maintenance work is to be performed, or to adjust a berth window in consideration of the time required for the maintenance work.

MODIFICATIONS

The embodiment described above can be variously modified within the scope of the technical idea of the present invention. Exemplary modifications will be described below. Two or more of the following modifications may be combined with each other.

(1) Server device 12 may perform at least part of the above processing of terminal device 11 in maintenance management system 1. Alternatively, terminal device 11 may perform at least part of the above processing of server device 12 in maintenance management system 1. For example, maintenance management system 1 may not include server device 12, and terminal device 11 may perform all processing that is performed by server device 12 in the above embodiment.

(2) In the above embodiment, relational-data-generation unit 123 generates the relational data relating to ship 8 without using the attribute record data and deterioration degree data for a ship other than ship 8. Alternatively, for example, relational-data-generation unit 123 may generate the relational data relating to ship 8 using the attribute record data and deterioration degree data for a ship of the same type as ship 8.

(3) In the above embodiment, only data acquired in ship 8 by measurement or other means is used for the attribute record data relating to the meteorological or hydrographic phenomenon. Alternatively, meteorological or hydrographic phenomenon data acquired from server device 13 may be used for at least part of the attribute record data relating to the meteorological or hydrographic phenomenon.

(4) In the above embodiment, terminal device 11 and server device 12 are each implemented by the general computer executing processing in accordance with the program. Alternatively, at least one of terminal device 11 and server device 12 may be a so-called dedicated device.

(5) In the above embodiment, the deterioration degree data indicates the degree of deterioration of the device checked by the worker while performing the maintenance work. However, when data indicating the degree of deterioration of a certain device can be measured by a measuring device, deterioration-degree-data-acquisition unit 122 may acquire data indicating the degree of deterioration that is determined based on the result of measurement by the measuring device as the deterioration degree data for this device.

(6) In the above embodiment, the relation between the deterioration degree and the attribute, which is indicated by the relational data, is not presented to the user. Alternatively, the relation between the deterioration degree and the attribute, which is indicated the relational data, may be presented to a user such as a worker or an operation manager, by display or by other means.

Figure 17:
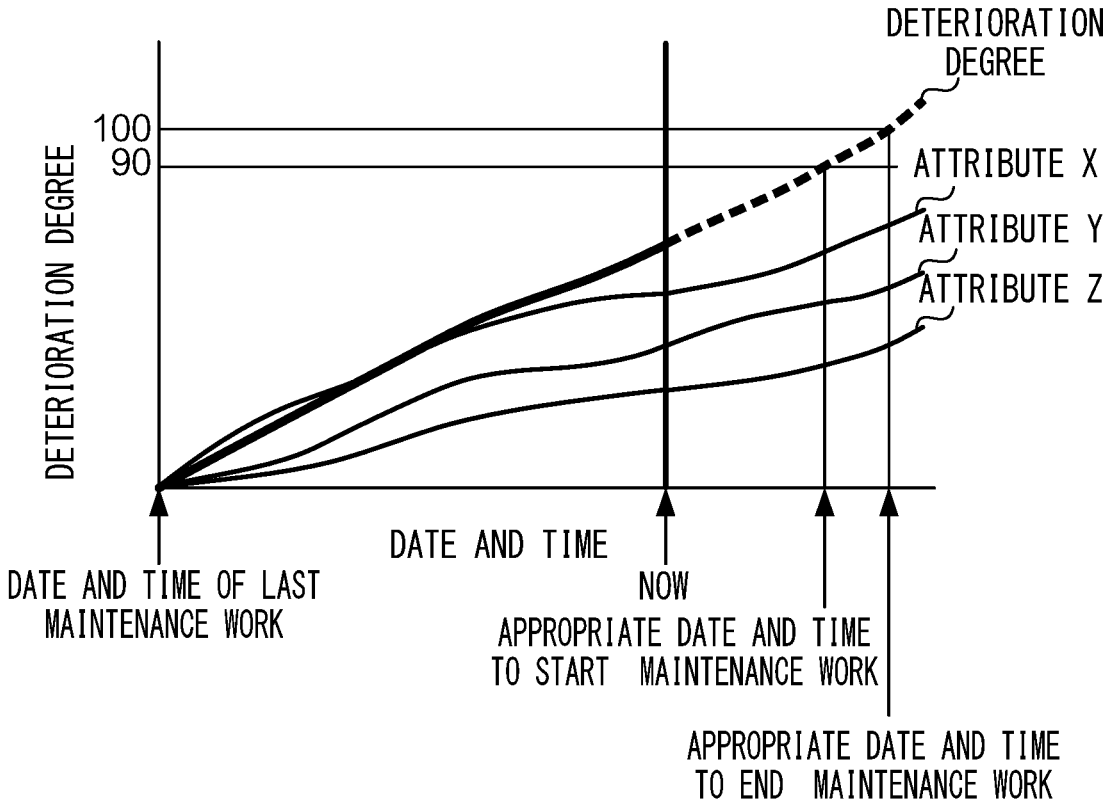
FIG. 17 is a diagram showing an example of a graph presented in the maintenance management system according to a modification.

(7) In the above embodiment, although the timing data is used to generate the maintenance schedule data, the contents indicated by the timing data are not presented to the user. Alternatively, the timing of maintenance work of the device indicated by the timing data may be presented to a user such as a worker or an operation manager, by display or by other means. FIG. 17 is a graph showing the timing of maintenance work to be performed on a certain device indicated by the timing data, together with the trend of the deterioration degree of the device and the trend of key attributes that affect the deterioration of the device. In FIG. 17, the horizontal axis in the graph indicates a date and time, where the timing indicated by the timing data is indicated as a range from an appropriate date and time to start the maintenance work to an appropriate date and time to end the maintenance work. In FIG. 17, the vertical axis in the graph indicates each value of the deterioration degree and the attributes (for some kinds of attribute, a cumulative value). FIG. 17 also shows lower threshold "90" and upper threshold "100" on the vertical axis to indicate the relation between the deterioration degree and the timing of the maintenance work. Furthermore, in FIG. 17 the left end of the horizontal axis in the graph indicates the date and time of the most recent maintenance work performed on the device. The graph exemplarily shown in FIG. 17 allows the user to understand intuitively the timing of the maintenance work to be performed on the device.

REFERENCE SIGNS LIST

1 . . . maintenance management system, 8 . . . ship, 9 . . . communication satellite, 10 . . . computer, 11 . . . terminal device, 12 . . . server device, 13 . . . server device, 14 . . . terminal device, 20 . . . computer, 101 . . . memory, 102 . . . processor, 103 . . . communication IF, 104 . . . display unit, 105 . . . operation device, 111 . . . attribute-record-data-acquisition unit, 112 . . . deterioration-degree-data-acquisition unit, 113 . . . transmission unit, 114 . . . reception unit, 115 . . . display unit, 121 . . . attribute-record-data-acquisition unit, 122 . . . deterioration-degree-data-acquisition unit, 123 . . . relational-data-generation unit, 124 . . . sailing-schedule-data-acquisition unit, 125 . . . estimated-attribute-data-acquisition unit, 126 . . . timing-data-generation unit, 127 . . . maintenance-constraint-data-acquisition unit, 128 . . . maintenance-schedule-data-generation unit, 129 . . . transmission unit, 201 . . . memory, 202 . . . processor, 203 . . . communication IF

What is claimed is:

1. A device comprising:

an attribute-record-data-acquisition unit configured to acquire attribute record data indicative of a plurality of attributes recorded during a past sailing of a ship and that relate to a state of sailing of the ship, each of the plurality of attributes including at least one attribute that does not relate to an operation state of a device mounted on the ship;

a deterioration-degree-data-acquisition unit configured to acquire deterioration degree data indicative of a deterioration degree of the device mounted on the ship, the deterioration degree being determined during a performance of maintenance work on the device; and a relational-data-generation unit configured to generate relational data indicative of a deterioration degree formula of the device based on the attribute record data and the deterioration degree data, the attribute record data being acquired by the attribute-record-data-acquisition unit, and the deterioration degree data being acquired by the deterioration-degree-data-acquisition unit, the deterioration degree formula including the plurality of attributes as variables.

2. The device according to claim 1, wherein at least one attributes includes at least one of a number of port calls by the ship, a route of sailing of the ship, a meteorological phenomenon or hydrographic phenomenon that the ship has encountered during sailing, an attitude of the ship, and a characteristic of fuel oil used by a main engine of the ship.

3. A device comprising:

a relational-data-acquisition unit configured to acquire relational data indicative of a deterioration degree formula of a device mounted on the ship, the deterioration degree formula including a plurality of attributes as variables, the plurality of attributes relating to a state of sailing of a ship, each of the plurality of attributes including at least one attribute that does not relate to an operation state of the device;

an attribute-record-data-acquisition unit configured to acquire attribute record data indicative of a record of the plurality of attributes recorded during a past sailing of the ship;

an estimated-attribute-data-acquisition unit configured to acquire estimated attribute data indicative of the plurality of attributes estimated for sailing of the ship; and a timing-data-generation unit configured to generate timing data indicative of a timing of maintenance work to be performed on the device based on a deterioration degree of the device, the deterioration degree being calculated by substituting a first attribute value with a second attribute value, the first attribute value corresponding to a first date and a first time and being indicated by the attribute record data acquired by the attribute-record-data-acquisition unit, the second attribute value corresponding from the first date and the first time to a second date and a second time and being indicated by the estimated attribute data acquired by the estimated-attribute-data-acquisition unit, with the formula indicated by the relational data acquired by the relational-data-acquisition unit, the formula including the plurality of attributes as variables.

4. The device according to claim 3, wherein the estimated-attribute-data-acquisition unit estimates at least one attribute for sailing of the ship based on a record of the plurality of attributes recorded during the past sailing of the ship, the record being indicated by the attribute record data, and generates and acquires estimated attribute data indicating the at least one estimated attribute.

5. The device according to claim 3, further comprising:

a sailing-schedule-data-acquisition unit configured to acquire sailing schedule data indicating a sailing schedule of the ship; and a maintenance-schedule-data-generation unit configured to generate maintenance schedule data indicating a timing and a location of maintenance work to be performed on the device based on the timing data and the sailing schedule data.

6. The device according to claim 3, wherein the plurality of attributes includes at least one of a number of port calls by the ship, a route of sailing of the ship, a meteorological phenomenon or hydrographic phenomenon that the ship has encountered during sailing, an attitude of the ship, and a characteristic of fuel oil used by a main engine of the ship.

7. A program that causes a computer to execute a process, the process comprising:

a first process of acquiring attribute record data indicative of a record of at least one attribute recorded during a past sailing of a ship and relating to a state of sailing of the ship, each of the plurality of attributes including at least one attribute that does not relate to an operation state of a device mounted on the ship;

a second process of acquiring deterioration degree data indicative of a deterioration degree of the device mounted on the ship, the deterioration degree being determined during a performance of maintenance work on the device; and a third process of generating relational data indicative of a deterioration degree formula of the device based on the attribute record data and the deterioration degree data, the deterioration degree formula including the plurality of attributes as variables.

8. A program that causes a computer to execute a process, the process comprising:

a first process of acquiring relational data indicative of a deterioration degree of a device mounted on a ship, a deterioration degree formula including a plurality of attributes as variables, the plurality of attributes relating to a state of sailing of a ship, each of the plurality of attributes including at least one attribute that does not relate to an operation state of the device;

a second process of acquiring attribute record data indicative of a record of the plurality of attributes recorded during a past sailing of the ship;

a third process of acquiring estimated attribute data indicative of the plurality of attributes estimated for a sailing of the ship; and a fourth process of generating timing data indicative of a timing of maintenance work to be performed on the device based on the deterioration degree of the device, the deterioration degree being calculated at a second date and a second time by substituting a first attribute value with a second attribute value, the first attribute value corresponding to until a first date and a first time and being indicated by the attribute record data, the second attribute value corresponding from the first date and the first time to the second date and the second time and being indicated by the estimated attribute data, with the formula indicated by the relational data, the formula including the plurality of attributes as variables.

9. A non-transitory computer readable recording medium recording and storing a program that causes a computer to execute a process, the process comprising:

a first process of acquiring attribute record data indicative of a record of at least one attribute recorded during a past sailing of a ship and that relate to a state of sailing of the ship, each of the plurality of attributes including the at least one attribute that does not relate to an operation state of a device mounted on the ship;

a second process of acquiring deterioration degree data indicative of a deterioration degree of the device mounted on the ship, the deterioration degree being determined during a performance of maintenance work on the device; and a third process of generating relational data indicative of a deterioration degree formula of the device based on the attribute record data and the deterioration degree data, the deterioration degree formula including the plurality of attributes as variables.

10. A non-transitory computer readable recording medium recording and storing a program that causes a computer to execute a process, the process comprising:

a first process of acquiring relational data indicative of a deterioration degree formula of a device mounted on a ship, the deterioration degree formula including a plurality of attributes relating to a state of sailing of the ship as variables, each of the plurality of attributes including at least one attribute that does not relate to an operation state of the device;

a second process of acquiring attribute record data indicative of a record of a plurality of attributes recorded during a past sailing of the ship;

a third process of acquiring estimated attribute data indicative of the plurality of attributes estimated for sailing of the ship; and a fourth process of generating timing data indicative of a timing of maintenance work to be performed on the device based on the deterioration degree of the device, the deterioration degree being calculated at a second date and a second time by substituting a first attribute value with a second attribute value, the first attribute value corresponding to a first date and a first time and being indicated by the attribute record data, the second attribute value corresponding from the first date and the first time to the second date and the second time and being indicated by the estimated attribute data, with the formula indicated by the relational data, the formula including the plurality of attributes as variables.

11. The device according to claim 1, wherein the deterioration degree is determined by a person during the performance of maintenance work on the device.

12. The device according to claim 1, wherein the deterioration degree is based on an appropriate timing of the performance of maintenance work on the device.

13. The device according to claim 12, wherein the deterioration degree is based on an evaluation of the timeliness of the performance of maintenance work on the device determined by the degree of deterioration of the device during the performance of maintenance work.

14. The device according to claim 1, wherein the deterioration degree is indicative of the performance of the maintenance work being performing at an appropriate time, at a late time or at a premature time based on the degree of deterioration of the device during the performance of the maintenance work.

15. The device according to claim 3, wherein the first date and the first time is at a last performance of maintenance work.

16. The device according to claim 3, wherein the first date and the first time is after a last performance of maintenance work.

* * * * *